US012560041B1

(12) United States Patent
Almalki et al.

(10) Patent No.: US 12,560,041 B1
(45) Date of Patent: Feb. 24, 2026

(54) MAGNETIZED WIRELINE PULLING TOOL

(71) Applicant: SAUDI ARABIAN OIL COMPANY, Dhahran (SA)

(72) Inventors: Abdullah Almalki, Jeddah (SA); Saeed Alghamdi, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 19/041,279

(22) Filed: Jan. 30, 2025

(51) Int. Cl.
*E21B 31/06* (2006.01)
*E21B 31/107* (2006.01)

(52) U.S. Cl.
CPC ..... *E21B 31/06* (2013.01); *E21B 31/107* (2013.01)

(58) Field of Classification Search
CPC ..... E21B 31/06; E21B 31/107
See application file for complete search history.

(56) References Cited

U.S. PATENT DOCUMENTS

| | | | | |
|---|---|---|---|---|
| 12,359,520 | B1 * | 7/2025 | Al-Shaikh | E21B 31/125 |
| 2008/0047710 | A1 * | 2/2008 | Rose | E21B 31/00 166/301 |
| 2015/0144354 | A1 * | 5/2015 | Cooper | E21B 31/00 166/54.5 |
| 2017/0114604 | A1 * | 4/2017 | Kartha | E21B 31/18 |
| 2019/0301258 | A1 * | 10/2019 | Li | E21B 47/08 |
| 2019/0376357 | A1 * | 12/2019 | Alssafwany | E21B 31/20 |
| 2022/0056777 | A1 * | 2/2022 | AlShehri | E21B 33/12 |
| 2022/0268120 | A1 * | 8/2022 | Al-Shehri | E21B 31/12 |

* cited by examiner

*Primary Examiner* — Neel Girish Patel
(74) *Attorney, Agent, or Firm* — Osha Bergman Watanabe & Burton LLP

(57) ABSTRACT

An apparatus includes a body having an upper end and a lower end, wherein the lower end of the body is configured to be lowered onto the fishneck of the fish, slips having a retrieval tool interface and located on the lower end of the body, and a magnet disposed on an external circumferential surface of the slips. The magnet is configured to remove the debris from the fishneck as the lower end of the body approaches the fish in the well. The retrieval tool interface is configured to engage with the fishneck when the slips are activated and after the debris is removed from the fishneck.

6 Claims, 4 Drawing Sheets

MAGNETIZED WIRELINE PULLING TOOL

BACKGROUND

Hydrocarbons are located in porous rock formations beneath the Earth's surface. Wells are drilled into these formations to access the hydrocarbons. Wireline systems are used for a variety of well construction and intervention activities during the life of the well. For example, wireline systems may be used to perform logging operations, lower devices into the well, retrieve/pull equipment, actuate downhole equipment, etc.

Wireline systems may retrieve a range of equipment left behind in the well. For example, wireline systems may be used to retrieve equipment that has purposely been left behind in the well to be retrieved at a later date, such as production equipment. In other examples, wireline systems may be used to retrieve stuck or lost equipment in the well. For both examples, the equipment may be covered with debris-making it difficult for the wireline systems to access the fish neck, or top, of the equipment.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

This disclosure presents, in accordance with one or more embodiments methods, systems and apparatuses for removing a fish, having a fishneck obstructed with debris, from a well. The apparatus includes a body having an upper end and a lower end, wherein the lower end of the body is configured to be lowered onto the fishneck of the fish, slips having a retrieval tool interface and located on the lower end of the body, and a magnet disposed on an external circumferential surface of the slips. The magnet is configured to remove the debris from the fishneck as the lower end of the body approaches the fish in the well. The retrieval tool interface is configured to engage with the fishneck when the slips are activated and after the debris is removed from the fishneck.

The system includes a fish having a fishneck disposed in a well, debris obstructing the fishneck, wireline configured to be deployed and retracted into and out of the well, and a bottom-hole-assembly (BHA). The BHA includes a body having an upper end and a lower end, wherein the upper end is connected to the wireline and the lower end is configured to be lowered onto the fishneck of the fish, slips having a retrieval tool interface and located on the lower end of the body, and a magnet disposed on an external circumferential surface of the slips. The magnet is configured to remove the debris from the fishneck as the lower end of the BHA approaches the fish in the well. The retrieval tool interface is configured to engage with the fishneck when the slips are activated and after the debris is removed from the fishneck. The BHA is configured to pull the fish from the well once the retrieval tool interface is engaged with the fishneck.

The method includes lowering a BHA into the well using wireline, locating a lower end of the BHA proximate to a fishneck of the fish, and removing debris obstructing the fishneck of the fish using a magnet disposed on an external circumferential surface of the BHA. The method also includes activating slips having a retrieval tool interface to engage the retrieval tool interface with an external surface of the fishneck when the BHA is lowered onto the fishneck and removing the fish from the well by pulling up on the BHA connected to the fish using the wireline.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements and have been solely selected for ease of recognition in the drawing.

DETAILED DESCRIPTION

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

During equipment retrieval operations performed using wireline systems, the equipment left downhole (also known as a "fish") may be covered with debris. The most common debris includes ferromagnetic debris from the metals used downhole. The debris prevents the wireline system from latching onto the top (also known as the "fishneck") of the fish. Available wireline systems do not have sufficient means of cleaning the debris from the fishneck of the fish in a single wireline run. As such, clean out runs must be performed prior to the retrieval run-taking a significant amount of time.

In hydrocarbon well operations, it is important to minimize time in the well, not only for efficiency and cost purposes, but also for the heath and safety of people and the environment. More time spent in the well is more time in which wellbore incidents may occur. Therefore, the ability to remove equipment from a well while simultaneously clearing the fishneck from debris is beneficial.

As such, embodiments disclosed herein present a wireline pulling tool that is designed with ajar down female connector and a magnet. The jar down female connector is used to latch onto a fishneck and jar on the fish to remove the fish form the well. The magnet is used to attract ferromagnetic debris from the fishneck of the fish to clear the latch mechanism-allowing the jar down female connector to successfully latch onto the fish neck.

Figure 1:
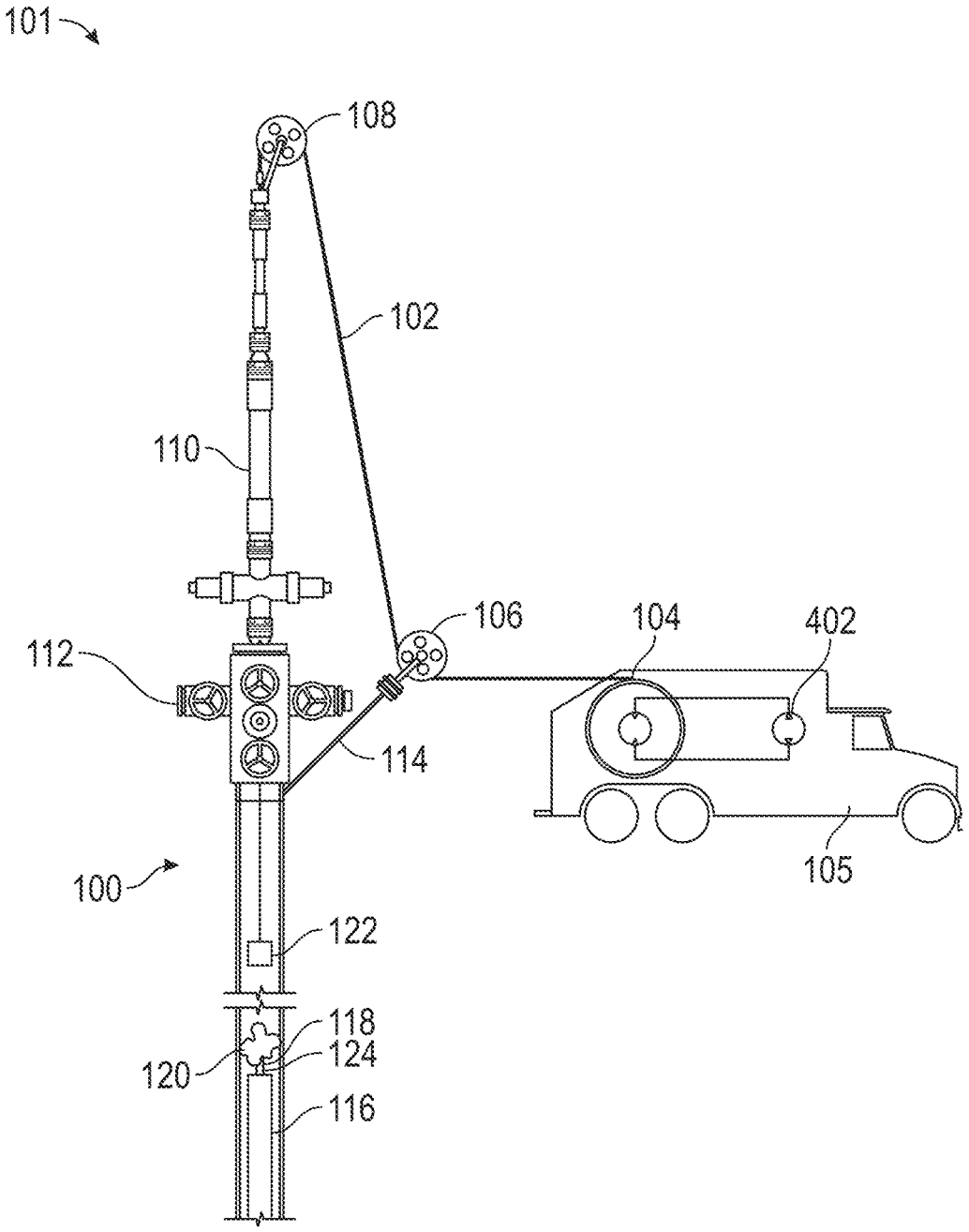
FIG. 1 shows a well and wireline system in accordance with one or more embodiments.

FIG. 1 shows a well (100) and wireline system (101) in accordance with one or more embodiments. A person skilled in the art will appreciate that the well (100) and the wireline system (101) are used for example purposes only and the well (100) and wireline system (101) may have any configuration known in the art without departing from the scope of this disclosure.

In accordance with one or more embodiments, the well (100) is a hole drilled into the Earth's surface that may be used to extract hydrocarbons from rock formations. The wireline operation consists of running wireline (102) into the well (100) to perform various wellbore operations such as jarring or fishing/retrieval operations. More specifically, the wireline operation utilizes a drum (104) to deploy or retract wireline (102) into or out of the well (100).

In accordance with one or more embodiments, the drum (104) is a conveyance device with a length of wireline (102) wrapped around a central axis. The drum (104) may be freestanding, or the drum (104) may be attached to an object, such as a wireline truck (105) that has a computer (402) system. The drum (104) may have electronic controls that control the deployment and retraction of the wireline (102).

In accordance with one or more embodiments, the drum (104) and the computer (402) system in the wireline truck (105) are electronically connected so that the computer (402) in the wireline truck (105) may control the deployment or retraction of the wireline (102) into the well (100). The computer (402) system is further outlined below in FIG. 4.

In accordance with one or more embodiments, the wireline (102) is a cable that has electrical/information transmission capabilities. Specifically, the wireline (102) is able to communicate with the computer (402) in the wireline truck (105). For example, the computer (402) may transfer inputs from user or inputs from computer programs (such as machine learning/artificial intelligence) through the wireline (102). Alternatively, the wireline (102) may transfer information from downhole equipment (any equipment located downhole within the well (100)) to the computer (402) system. The wireline (102) may also transfer power to the downhole equipment from a power system (not pictured).

In accordance with one or more embodiments, the wireline (102) is directed into the well (100) through two sheaves: a lower sheave (106) and an upper sheave (108). Sheaves are devices that are used to hold/redirect cables and lift loads. As depicted in FIG. 1 the lower sheave (106) and the upper sheave (108) hold and redirect the wireline (102) towards the well (100). Further, the lower sheave (106) and the upper sheave (108) spin on axles which allows the wireline (102) to move freely. Prior to the wireline (102) entering the well (100), the wireline (102) passes through a lubricator (110) and a wellhead (112).

In accordance with one or more embodiments, the lubricator (110) is made of high-pressure pipe and an assortment of valves. The lubricator (110) controls the difference in pressure between the pressurized well (100) and the atmosphere. In accordance with one or more embodiments, the wellhead (112) is the surface termination of the well (100). The wellhead (112) is a system of spools, valves, and assorted adapters that provide pressure control of the well (100). In accordance with one or more embodiments, the wellhead (112) may represent both a production tree and casing hangers. The lower sheave (106) may be attached to the well (100) though a chain (114).

The chain (114) allows the lower sheave (106) to move freely in all directions. The upper sheave (108) may be fixed to the lubricator (110) by a pipe or pipes welded, or otherwise connected, to both the lubricator (110) and the upper sheave (108). The upper sheave (108) may be held up by a crane or any other means known in the art.

FIG. 1 further shows a fish (116) located in the well (100). The fish (116) may be equipment that has purposely been left behind in the well (100) to be retrieved at a later date, such as production equipment. The fish (116) may also be stuck or lost equipment in the well (100). The top/upper portion of the fish (116) is the fishneck (118). Herein "top/upper portion" refers to the portion of the equipment that is located up-hole, meaning it is the portion of the fish (116) that is located closest to the exit-to-the-surface of the well (100). The fishneck (118) has an external surface (124). The external surface (124) is the outer surface of the fishneck (118)

The fishneck (118) may include a specially-designed interface on the external surface (124) whose purpose is to interact with a retrieval tool to enable removal of the fish (116) from the well (100), such as is the case with equipment purposefully left behind in the well (100). In other embodiments, the fishneck (118) is simply the upper-most portion of the stuck or lost equipment. Debris (120) is shown covering the fishneck (118).

FIG. 1 further shows the wireline (102) lowering a bottom-hole-assembly (BHA) (122) into the well (100) to retrieve the fish (116). The BHA (122) may be a retrieval/pulling tool in accordance with one or more embodiments. The BHA (122) is further outlined in FIGS. 2*a*-3*b*. In accordance with one or more embodiments, the BHA (122) is in electronic communication with the wireline (102). Thus, the BHA (122) is able to electronically communicate with the computer (402) system via the wireline (102).

Figure 2B:
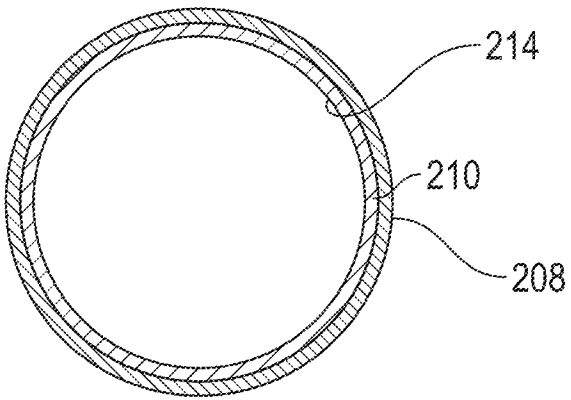
FIGS. 2*a*-2*b* show the wireline BHA in accordance with one or more embodiments.
Figure 2A:
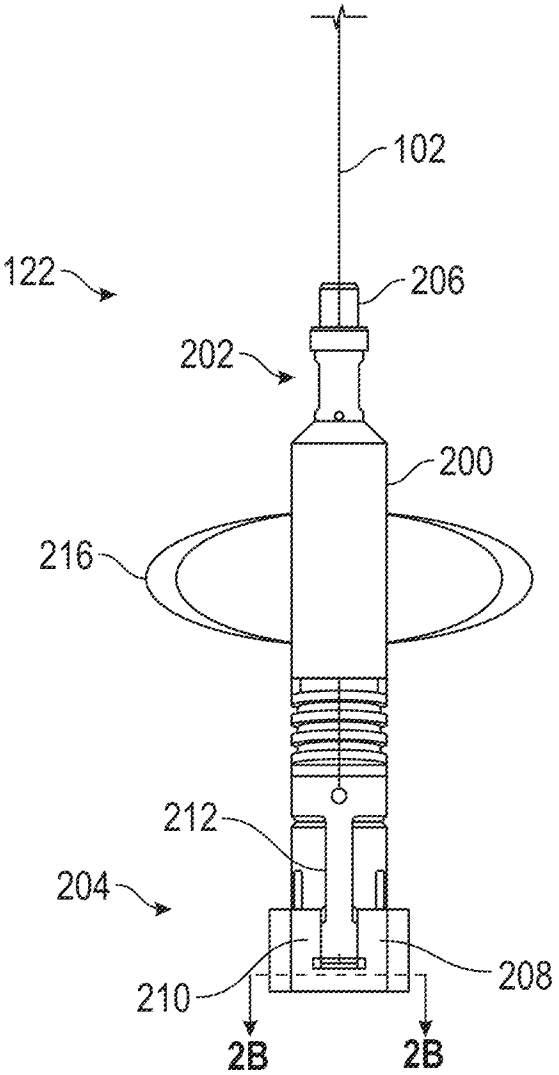

FIGS. 2*a*-2*b* show the wireline (102) BHA (122) in accordance with one or more embodiments. Components shown in FIGS. 2*a*-2*b* that are the same as or similar to components shown in FIG. 1 have not be re-described for purposes of readability and have the same description and function as outlined above. Specifically, FIG. 2*a* shows a side view of the BHA (122) and FIG. 2*b* shows a bottom view of the BHA (122).

The BHA (122) is shown connected to the downhole-most end of the wireline (102). The wireline (102) is used to lower or raise the BHA (122) into/out of the well (100). In accordance with one or more embodiments, the BHA (122) includes a body (200) having an upper end (202) and a lower end (204).

The upper end (202) is connected to the wireline (102) through a connection (206). The connection (206) physically and electronically couples the upper end (202) of the body (200) to the wireline (102). Thus, movement of the wireline (102) causes movement of the body (200) of the BHA (122)

and the wireline (102) can send and receive electronic signals to/from the body (200) of the BHA (122).

The body (200) may include a computer processor, not pictured, that sends or receives electronic signals to/from the BHA (122) to the computer (402) using the wireline (102). Furthermore, the computer processor may send signals within the BHA (122) to sub-components (such as a magnet (208), slips (210), and jars (212)) to perform a particular action.

The lower end (204) of the body (200) includes the magnet (208), slips (210), and jars (212). The magnet (208) is circumferentially disposed on a side-profile circumferential surface of the slips (210). The magnet (208) is used to attract and remove the debris (120) from the fishneck (118).

In accordance with one or more embodiments, the magnet (208) is a magnet with strong magnetic characteristics, such as a neodymium magnet. Thus, once the BHA (122) approaches the fishneck (118), any ferromagnetic material in the debris (120) is pulled off of the fishneck (118) and is connected to the magnet (208).

In other embodiments, the magnet (208) is an electromagnet that can be magnetized and de-magnetized using power from the wireline (102). Thus, when the BHA (122) is close to the depth of the fish (116), a user or a program in the computer (402) may send a signal to the magnet (208) to turn on and become magnetized using the wireline (102). The ability to control the magnetization of the magnet (208) prevents the magnet (208) from attracting unwanted material when the BHA (122) is lowered in the well (100).

The magnet (208) may be any physical size and the physical size may be increased or decreased depending on the estimated debris (120) located on the fishneck (118). Furthermore, in the case of the electromagnet, the strength of the magnet (208) may be controlled using the computer (402) and may be increased or decreased depending on the requirements of the retrieval operation.

As outlined above, the most common debris (120) includes ferromagnetic material because often the only equipment in a well (100) is made of metals, thus the only debris created, beyond scale and sand, includes ferromagnetic materials. Because the magnet (208) is located on the side profile of the BHA (122), the debris (120) will be stored on the sides of the BHA (122), allowing space beneath (downhole) the lower end (204) of the BHA (122). As such, the majority of the debris (120) may be attracted to the magnet (208) such that the fishneck (118) of the fish (116) is sufficiently cleared so the slips (210) can engage with the fishneck (118).

The slips (210) have a retrieval tool interface (214) that is configured to interact with the external surface (124) of the fishneck (118). Specifically, when the BHA (122) is lowered on top of the fishneck (118) the slips (210) are triggered to tighten around the fishneck (118) such that the retrieval tool interface (214) tightens and grips onto the external surface (124) of the fishneck (118).

The slips (210) may be physically or electronically triggered to grip onto the fishneck (118). Specifically, when the BHA (122) lowers onto the fishneck (118), weight is transferred between the BHA (122) and the fishneck (118). This weight transfer allows the retrieval tool interface (214) of the slips (210) to engage with the external surface (124) of the fishneck (118).

In other embodiments, the slips (210) are electronically triggered by sending a message from the computer (402) to the BHA (122) via the wireline (102). The message instructs the slips (210) to grip onto the fishneck (118).

The BHA (122) further includes jars (212) located within the body (200) of the BHA (122). The jars (212) are used to create an impact force on the fish (116) to free the fish (116). The jars (212) may be mechanically or electronically controlled.

Specifically, when the BHA (122) latches onto the fishneck (118) and begins to pull up on the fish (116), the pulling force seen across the jars (212) and body (200) of the BHA (122) may trigger the jars (212) to jar and deliver the impact force to the fish (116) through the fishneck (118).

In other embodiments, the jars (212) are electronically triggered by sending a message from the computer (402) to the BHA (122) via the wireline (102). The message instructs the jars (212) to activate and deliver the impact force to the fish (116).

The BHA (122) may also include one or more centralizers (216) located on an external surface of the body (200). The centralizers (216) are used to keep the BHA (122) within the center of the well (100) so that the magnet (208) does not connect to sidewalls of the well (100) (such as the inner wall of a casing string disposed in the well (100)). The centralizers (216) may be any type known in the art, such as bow spring, hinged, welded, classic, rigid, spiral vane, straight vane, composite, etc.

Figure 3A:
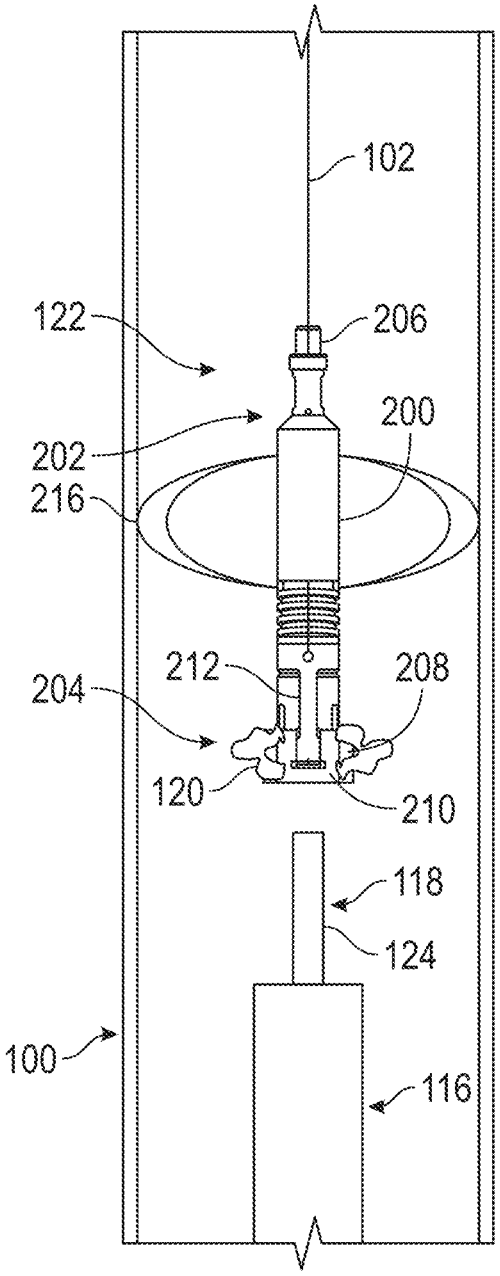
FIGS. 3*a*-3*b* show the BHA being used to clear debris from the fishneck of the fish and remove the fish from the well in one trip and in accordance with one or more embodiments.
Figure 3B:
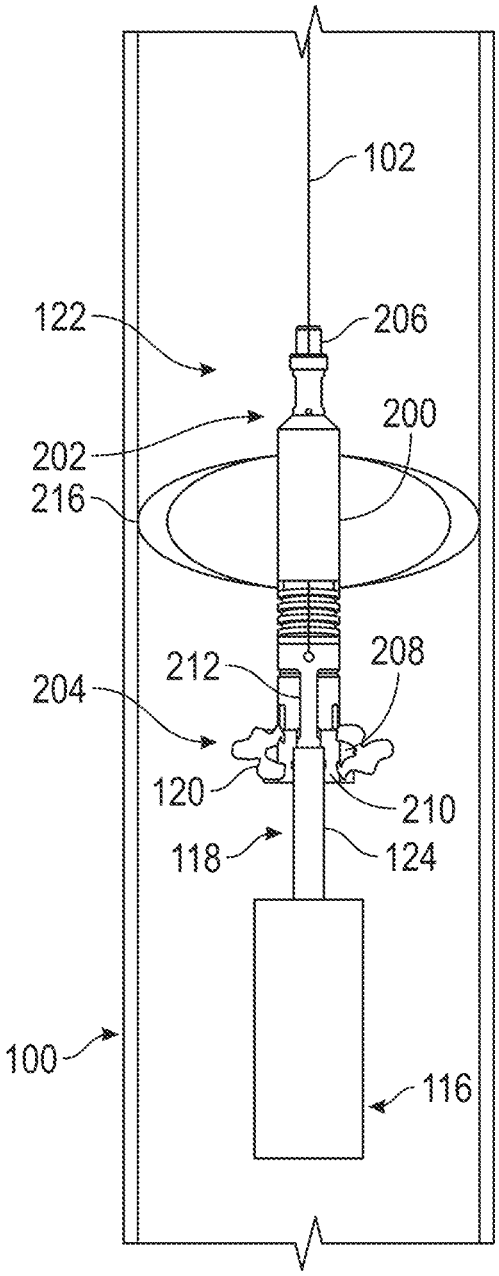

FIGS. 3*a*-3*b* show the BHA (122) being used to clear debris (120) from the fishneck (118) of the fish (116) and remove the fish (116) from the well (100) in one trip and in accordance with one or more embodiments. Components shown in FIGS. 3*a*-3*b* that are the same as or similar to components shown in FIGS. 1-2*b* have not be re-described for purposes of readability and have the same description and function as outlined above.

Specifically, FIG. 3*a* shows the magnet (208) removing debris from the fishneck (118) of the fish (116). FIG. 3*b* shows the BHA (122) after it has gripped onto the fishneck (118) of the fish (116) and is in the process of pulling the fish (116) from the well (100).

Turning to FIG. 3*a*, as the BHA (122) approaches the fish (116) in the well (100), the magnet (208) attracts the debris (120), removing the debris (120) from the fishneck (118) of the fish (116). As outlined above, the magnet (208) may automatically attract the debris (120) as the BHA (122) approaches the fish (116) because the magnet (208) is permanently magnetized. In other embodiments, the magnet (208) may switch on, using a signal from the wireline (102), to become magnetized and attract the debris (120) as the BHA (122) approaches the fish (116).

As can be seen in FIG. 3*a*, the debris (120) is connected to the magnet (208) and is thus located on the sides of the BHA (122), due to the placement off the magnet (208) on the external circumferential surface of the slips (210). At this point, the majority of the debris (120) is removed from the fishneck (118) allowing the external surface (124) of the fishneck (118) to be clear to engage with the retrieval tool interface (214) of the BHA (122).

Specifically, the BHA (122) is lowered over the fishneck (118) such that the fishneck enters the BHA (122) within the slips (210). Once the fishneck (118) is located within the slips (210) of the BHA (122), the slips (210) may activate, (either electronically using a signal or physically using weight transfer) to grip onto the fishneck (118). In accordance with one or more embodiments, the grip should be sufficient such that the BHA (122) can hold the weight of the fish (116). FIG. 3*b* shows the slips (210) engaged with the fishneck (118) and the BHA (122) pulling the fish (116) from the well (100). As the BHA (122) pulls up on the fish (116), the jars (212) may be activated (physically or electronically)

to transfer an impact force to the fish (116) to loosen the fish (116), making it easier to remove the fish (116) from the well (100).

FIGS. 3*a* and 3*b* also show the centralizer (216) keeping the BHA (122) centralized in the well (100) as the BHA (122) is lowered into the well (100) and as the BHA (122) and the fish (116) are being pulled from the well (100). In accordance with one or more embodiments and when the magnet (208) is an electromagnet, the magnet (208) may be turned off once the BHA (122) has engaged with the fishneck (118) so that the magnet (208) does not become attracted to anything else in the well (100) as the BHA (122) pulls the fish (116) from the well (100).

Figure 4:
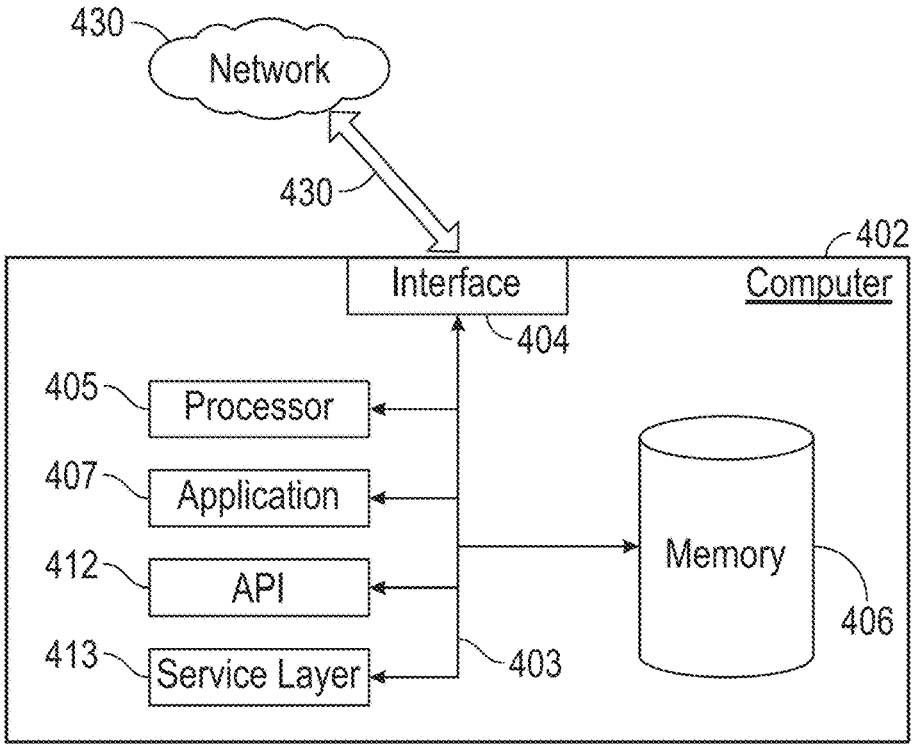
FIG. 4 shows a computer system in accordance with one or more embodiments.

FIG. 4 shows a computer (402) system in accordance with one or more embodiments. Specifically, FIG. 4 shows a block diagram of a computer (402) system used to provide computational functionalities associated with described algorithms, methods, functions, processes, flows, and procedures as described in the instant disclosure, according to an implementation. The illustrated computer (402) is intended to encompass any computing device such as a server, desktop computer, laptop/notebook computer, wireless data port, smart phone, personal data assistant (PDA), tablet computing device, one or more processors within these devices, or any other suitable processing device, including both physical or virtual instances (or both) of the computing device.

Additionally, the computer (402) may include a computer that includes an input device, such as a keypad, keyboard, touch screen, or other device that can accept user information, and an output device that conveys information associated with the operation of the computer (402), including digital data, visual, or audio information (or a combination of information), or a GUI.

The computer (402) can serve in a role as a client, network component, a server, a database or other persistency, or any other component (or a combination of roles) of a computer system for performing the subject matter described in the instant disclosure. The illustrated computer (402) is communicably coupled with a network (430). In some implementations, one or more components of the computer (402) may be configured to operate within environments, including cloud-computing-based, local, global, or other environment (or a combination of environments).

At a high level, the computer (402) is an electronic computing device operable to receive, transmit, process, store, or manage data and information associated with the described subject matter. According to some implementations, the computer (402) may also include or be communicably coupled with an application server, e-mail server, web server, caching server, streaming data server, business intelligence (BI) server, or other server (or a combination of servers).

The computer (402) can receive requests over network (430) from a client application (for example, executing on another computer (402)) and responding to the received requests by processing the said requests in an appropriate software application. In addition, requests may also be sent to the computer (402) from internal users (for example, from a command console or by other appropriate access method), external or third-parties, other automated applications, as well as any other appropriate entities, individuals, systems, or computers.

Each of the components of the computer (402) can communicate using a system bus (403). In some implementations, any or all of the components of the computer (402), both hardware or software (or a combination of hardware and software), may interface with each other or the interface (404) (or a combination of both) over the system bus (403) using an application programming interface (API) (412) or a service layer (413) (or a combination of the API (412) and service layer (413). The API (412) may include specifications for routines, data structures, and object classes. The API (412) may be either computer-language independent or dependent and refer to a complete interface, a single function, or even a set of APIs. The service layer (413) provides software services to the computer (402) or other components (whether or not illustrated) that are communicably coupled to the computer (402).

The functionality of the computer (402) may be accessible for all service consumers using this service layer. Software services, such as those provided by the service layer (413), provide reusable, defined business functionalities through a defined interface. For example, the interface may be software written in JAVA, C++, or other suitable language providing data in extensible markup language (XML) format or other suitable format. While illustrated as an integrated component of the computer (402), alternative implementations may illustrate the API (412) or the service layer (413) as stand-alone components in relation to other components of the computer (402) or other components (whether or not illustrated) that are communicably coupled to the computer (402). Moreover, any or all parts of the API (412) or the service layer (413) may be implemented as child or sub-modules of another software module, enterprise application, or hardware module without departing from the scope of this disclosure.

The computer (402) includes an interface (404). Although illustrated as a single interface (404) in FIG. 4, two or more interfaces (404) may be used according to particular needs, desires, or particular implementations of the computer (402). The interface (404) is used by the computer (402) for communicating with other systems in a distributed environment that are connected to the network (430). Generally, the interface (404) includes logic encoded in software or hardware (or a combination of software and hardware) and operable to communicate with the network (430). More specifically, the interface (404) may include software supporting one or more communication protocols associated with communications such that the network (430) or interface's hardware is operable to communicate physical signals within and outside of the illustrated computer (402).

The computer (402) includes at least one computer processor (405). Although illustrated as a single computer processor (405) in FIG. 4, two or more processors may be used according to particular needs, desires, or particular implementations of the computer (402). Generally, the computer processor (405) executes instructions and manipulates data to perform the operations of the computer (402) and any algorithms, methods, functions, processes, flows, and procedures as described in the instant disclosure.

The computer (402) also includes a non-transitory computer (402) readable medium, or a memory (406), that holds data for the computer (402) or other components (or a combination of both) that can be connected to the network (430). For example, memory (406) can be a database storing data consistent with this disclosure. Although illustrated as a single memory (406) in FIG. 4, two or more memories may be used according to particular needs, desires, or particular implementations of the computer (402) and the described functionality. While memory (406) is illustrated as an integral component of the computer (402), in alternative implementations, memory (406) can be external to the computer (402).

The application (407) is an algorithmic software engine providing functionality according to particular needs, desires, or particular implementations of the computer (402), particularly with respect to functionality described in this disclosure. For example, application (407) can serve as one or more components, modules, applications, etc. Further, although illustrated as a single application (407), the application (407) may be implemented as multiple applications (407) on the computer (402). In addition, although illustrated as integral to the computer (402), in alternative implementations, the application (407) can be external to the computer (402).

There may be any number of computers (402) associated with, or external to, a computer system containing computer (402), each computer (402) communicating over network (430). Further, the term "client," "user," and other appropriate terminology may be used interchangeably as appropriate without departing from the scope of this disclosure. Moreover, this disclosure contemplates that many users may use one computer (402), or that one user may use multiple computers (402).

Figure 5:
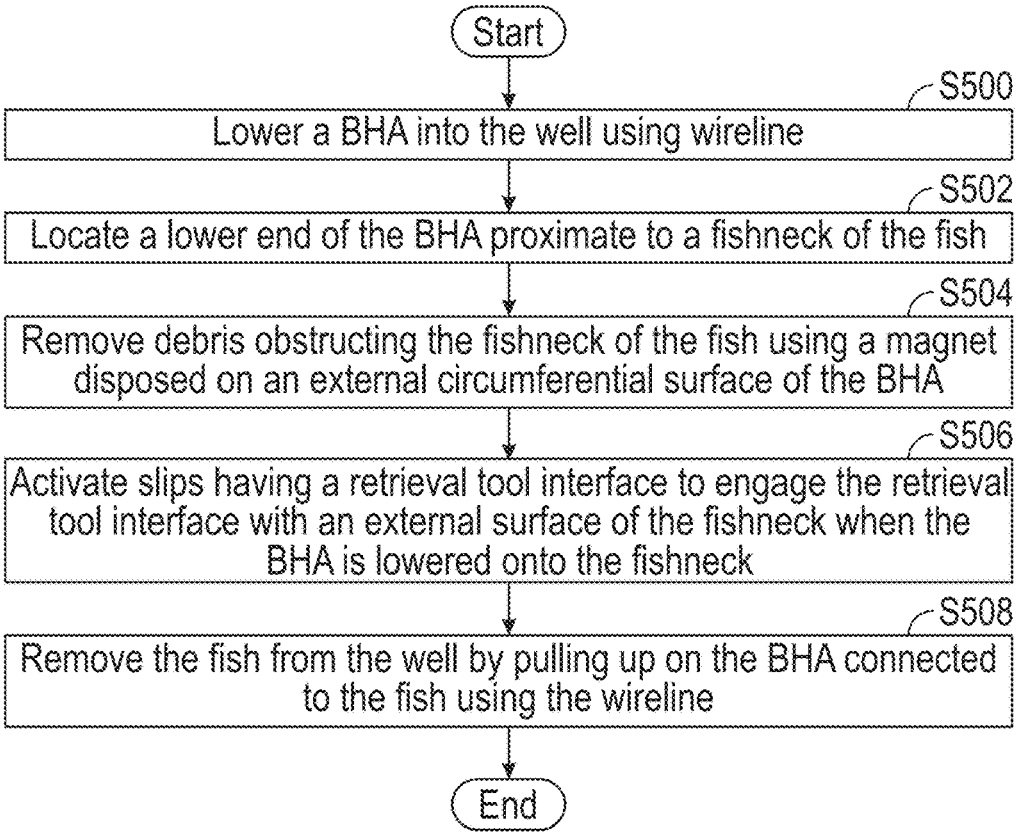
FIG. 5 shows a flowchart in accordance with one or more embodiments.

FIG. 5 shows a flowchart in accordance with one or more embodiments. The flowchart outlines a method for removing a fish (116) from a well (100). While the various blocks in FIG. 5 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

A fish (116) may be located in a well (100) and may have a fishneck (118) that is obstructed with debris (120). The fish (116) may be any equipment located in the well (100) that was intentionally or accidentally left in the well (100). A BHA (122) connected to wireline (102) may be used to remove the fish (116) from the well (100).

In S500, the BHA (122) is lowered into the well (100) using the wireline (102). In accordance with one or more embodiments, the BHA (122) is made of a body (200) that has an upper end (202) and a lower end (204). A connection (206) physically and electronically connects the upper end (202) of the BHA (122) to the wireline (102). The lower end of the BHA (122) has slips (210) and a magnet (208) disposed around the slips (210).

The wireline (102) is lowered into and retracted from the well (100) using a drum (104) that may be connected to a wireline truck (105). The wireline truck (105) may include a computer (402) system that is able to communicate with the BHA (122) though the electrically-conductive wireline (102).

In S502, a lower end (204) of the BHA (122) is located proximate to a fishneck (118) of the fish (116). In S504, debris (120) obstructing the fishneck (118) of the fish (116) is removed using a magnet (208) disposed on an external circumferential surface of the BHA (122).

In accordance with one or more embodiments, the debris (120) includes ferromagnetic material that is attracted to the magnetic properties of the magnet (208). Thus, as the lower end (204) of the BHA (122) approaches the debris (120) located on the fishneck (118), the debris (120) is attracted to the magnet (208) and sticks to the magnet (208).

In accordance with one or more embodiments, the magnet (208) is a neodymium magnet and is magnetized the entire time the magnet (208) is in the well (100). In other embodiments, the magnet (208) is an electromagnet that can be magnetized and de-magnetized using electricity from the wireline (102).

In the electromagnet embodiments, the magnet (208) may be switched on using a command from the wireline (102) as the BHA approaches the fishneck (118). The ability to control when the magnet (208) is magnetized prevents unwanted debris from sticking to the magnet (208) and also prevents the magnet (208) from being attracted to other equipment (such as casing strings) within the well (100).

The BHA (122) may also include centralizers (216) connected to the body (200). The centralizers use their geometry to centralize the BHA (122) within the well (100). Using centralizers (216) prevents the magnet (208) of the BHA (122) from sticking to the sidewalls of the well (100).

In S506, slips (210) having a retrieval tool interface (214) is activated to engage with an external surface (124) of the fishneck (118) when the BHA (122) is lowered onto the fishneck (118). In accordance with one or more embodiments, the slips (210) are mechanically activated due to a transfer of weight between the BHA (122) and the fish (116) when the BHA (122) is lowered onto the fishneck (118). In other embodiments, the slips (210) are electronically activated by sending a signal to the BHA (122) through the wireline (102) using the computer (402).

Once the retrieval tool interface (214) has engaged with the external surface (124) of the fishneck (118), the BHA (122) may pull up on the fish (116) by retrieving the wireline (102) from the well (100) using the drum (104). In accordance with one or more embodiments, the BHA (122) further includes jars (212) that are activated due to pulling up on the BHA (122) connected to the fish (116).

When the jars (212) activate, the jars (212) transfer an impact force to the fish (116). The impact force may loosen the fish (116) within the well (100), making it easier to remove the fish (116) from the well (100) using the BHA (122). In S508. the fish (116) is removed from the well (100) by pulling up on the BHA (122) connected to the fish (116) using the wireline (102).

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed is:

1. A method for removing a fish from a well, the method comprising:

lowering a BHA into the well using wireline;

locating a lower end of the BHA proximate to a fish neck of the fish;

removing debris obstructing the fish neck of the fish using a magnet disposed on an external circumferential surface of the BHA;

storing the debris, via the magnet, on an outer surface of the body;

activating slips having a retrieval tool interface to engage the retrieval tool interface with an external surface of the fish neck when the BHA is lowered onto the fish neck; and removing the fish from the well by pulling up on the BHA connected to the fish using the wireline.

2. The method of claim 1, wherein removing the debris from the fish neck using the magnet further comprises magnetizing the magnet by sending electricity to the magnet using the wireline when the lower end of the BHA approaches the fish.

3. The method of claim 1, wherein activating the slips further comprises mechanically activating the slips due to a transfer of weight between the BHA and the fish when the BHA is lowered onto the fish neck.

4. The method of claim 1, wherein activating the slips further comprises electronically activating the slips by sending a signal to the BHA through the wireline.

5. The method of claim 1, wherein pulling up on the BHA further comprises activating jars to create an impact force on the fish.

6. The method of claim 1, further comprising centralizing the BHA in the well using centralizers located on the BHA.

* * * * *